US005676214A

United States Patent [19]

Pearce et al.

[11] Patent Number: 5,676,214

[45] Date of Patent: Oct. 14, 1997

[54] FLOW CHANNELS FOR TOOTH TYPE ROLLING CUTTER DRILL BITS

[75] Inventors: David E. Pearce, Spring; James C. Walter, Mesquite, both of Tex.

[73] Assignee: Camco International Inc., Houston, Tex.

[21] Appl. No.: 627,171

[22] Filed: Apr. 3, 1996

[30] Foreign Application Priority Data

Apr. 13, 1995 [GB] United Kingdom ..... 9507703

[51] Int. Cl.[6] ..... E21B 10/18

[52] U.S. Cl. ..... 175/340

[58] Field of Search ..... 175/339, 340

[56] References Cited

U.S. PATENT DOCUMENTS

| | | | |
|---|---|---|---|
| 1,784,476 | 12/1930 | Zublin et al. | 175/340 |
| 1,990,007 | 2/1935 | Sperry | 175/340 X |
| 2,108,955 | 2/1938 | Zublin | 175/340 |
| 2,886,293 | 5/1959 | Carr et al. | 175/339 |
| 2,939,684 | 6/1960 | Payne . | |
| 3,618,682 | 11/1971 | Bennett | 175/65 |
| 4,167,220 | 9/1979 | Ernst et al. | 175/339 X |
| 4,516,642 | 5/1985 | Childers et al. | 175/340 |
| 4,546,837 | 10/1985 | Childers et al. | 175/340 |
| 5,096,005 | 3/1992 | Ivie et al. | 175/340 |

FOREIGN PATENT DOCUMENTS 1104310 2/1968 United Kingdom .

*Primary Examiner*—Hoang C. Dang

[57] ABSTRACT

A moth type rolling cutter drill bit has a plurality of rolling cutters mounted on legs, each rolling cutter having a back face portion and a gage face portion, and a high velocity fluid nozzle which directs a stream of high velocity fluid toward the cutter. Each cutter has a row of gage teeth to cut the gage of the borehole, and at least one of the cutters has a plurality of flow channels spaced apart around its gage face portion to provide fluid communication from the back face of the cutter and between and around pairs of adjacent gage teeth. Each flow channel is inclined at an angle to a radius of the cutter so as to be oriented towards the stream of fluid from the high velocity nozzle as the teeth adjacent to the flow channel engage the formation being drilled.

10 Claims, 2 Drawing Sheets

FLOW CHANNELS FOR TOOTH TYPE ROLLING CUTTER DRILL BITS

BACKGROUND OF INVENTION

1. Field of Invention

This invention relates to rolling cutter earth boring bits with steel teeth integrally formed on the cutters and which utilize nozzles to accelerate drilling fluid to dean and transport cuttings away from the bit and the hole bottom. More specifically, this invention relates to an improved steel tooth cutter geometry designed to improve the hydraulic action of drilling fluid against the bit and the rock to be drilled.

2. Description of Related Art

As often described in prior art, drill bit balling, bottom hole balling, and chip hold down problems can severely limit drilling progress in the sedimentary rocks commonly drilled using soft formation rolling cutter bits. It has been observed in both laboratory and field drilling tests that drilling rates are strongly affected by the hole bottom location of chip hold down and balling. Chip hold down and balling occurring at the outer portion of the bit face and the outer periphery of the hole bottom reduce drilling rates significantly more than balling which occurs elsewhere. In addition, it is generally understood that fluid cleaning of the hole bottom and the bit teeth should optimally occur when the teeth are exerting mechanical stress on the rock at their point of cutting engagement. Therefore, numerous attempts have been made to overcome chip hold down and balling by directing the hydraulic energy toward the underside of the rolling cutters at the outer portion of the hole bottom where it can be most effective.

Bennett in U.S. Pat. No. 3,618,682 shows low pressure, low velocity hydraulic passages formed in the back of the bit leg to deliver fluid to a specific exit point at the gage face of the cutter near the hole bottom. Sudden changes in fluid direction, combined with the use of the hole wall to channel the fluid limit this design to a low velocity fluid distribution to avoid erosion of the bit body and hole wall. The lack of high-pressure, high-velocity flow renders this design ineffective in modem chip hold down drilling environments.

Feenstra in British Patent 1,104,310 shows an extended, angled jet nozzle directed from the side of the rolling cutter to a point underneath the cutter, where the outer teeth are in cutting engagement with the rock. The flow is directed across the teeth, which limits its effectiveness in cleaning cuttings packed in axial recesses between teeth. In addition, the changes in flow direction inside the nozzle passageway make it susceptible to fluid erosion. Requirements for the flow area and wall thickness of the nozzle passageway give rise to compromises between design space and structural integrity. For these reasons, extended nozzles with significantly curved passages have had limited success in rolling cutter bit applications.

Childers, et al, in U.S. Pat. Nos. 4,516,642 and 4,546,837 employ a high velocity flow stream directed tangent to the rolling cutter profile and toward an impact point on the outer portion of the hole bottom adjacent to the cutting engagement of the teeth. This design cleans first the teeth and then the outer hole bottom in separate, sequential actions, without the use of an extended curved nozzle.

An improved design which simultaneously cleans both the outer teeth and the outer portion of the hole bottom at the point of cutting engagement is shown by Ivie, et al. in U.S. Pat. No. 5,096,005. This design uses a conventional nozzle mounted in the body of the bit to direct fluid to an impact point on the corner of the hole wall, at the leading side of the tooth engagement area of the outer row of teeth. Due to the geometry of the hole corner and the impact angle of the high velocity stream, the fluid stream sweeps around the corner of the hole and travels inward underneath the cutter. This arrangement provides a concentrated high velocity flow across the rock surface and between the outermost teeth where they are in cutting contact with the hole corner and the hole bottom. Under chip hold down and balling conditions, penetration rate increases of up to 70% were obtained compared to conventional nozzle designs when tested in tungsten carbide insert bits.

Unfortunately, lesser results have been obtained using the nozzle design described by Ivie on steel tooth bits. One possible reason for this is that the recesses between traditionally manufactured steel teeth are much deeper and have increased axial length, making them more susceptible to heavily packed bit balling. In addition, the length and orientation of the steel teeth provide much more of an obstruction to the fluid as it travels across the rock surface through the tooth engagement area. These geometric factors limit access of the high velocity fluid to overcome chip hold down and balling problems at the point of cutting.

The prior art shows examples of steel tooth bits with modifications to the tooth structures which allow flow through the tooth engagement area. The previously cited Bennett patent shows small radially aligned notches in the gage face of the rolling cutters. Another design shown by Payne in U.S. Pat. No. 2,939,684, has an interrupted web between the outermost teeth, with small radial notches for fluid access. Finally, a great number of commercially available steel tooth bit designs have shallow radial notches in the gage face of the cutters to aid in the application of hardfacing. Each of these designs have relatively small radially aligned notches which are not designed to deliver large volumes of high velocity fluid to the recesses between teeth.

SUMMARY OF THE INVENTION

The object of the present invention is to provide a rolling cutter steel tooth bit with directed fluid-accelerating nozzles in the bit body and fluid access channels on the cutters which are cooperatively designed to overcome chip hold down and balling during cutting at the outer portion of the hole.

The fluid channels begin at the gage face of the cutter and are oriented at an angle toward a directed nozzle on the bit. The channel then communicates with the recesses between and around adjacent gage teeth on the cutter. In a further embodiment, the recesses between adjacent teeth form continuous passageways for fluid flow across the rock surface under the entire face of the cutter toward the bit centre. The passageways are typically designed to flatten and widen at the inner rows of the cutter.

At least a majority of the gage teeth are separated by a flow channel, although preferably a flow channel exists between each pair of adjacent gage teeth. The design of the cutter is such that no sharp edges are exposed to high velocity flow, thereby minimizing eddies. Also, there are no sharp comers in the channel bottom. This reduces balling, reduces erosion, and minimizes stress concentrations at the base of the teeth. Optionally, the base of the cutter teeth and the walls of the flow channel can be coated with an erosion resistant material. Also, corresponding passages can be formed in the gage surface of the bit leg to help direct flow into the channels at the cutter backface.

The sizes of the flow channels affect the amount of fluid available for flowing across the rock and cutter surfaces.

Accordingly, the flow channels are sized relative to the bit's diameter to produce the desired flow through the passageways on the cutter face. The flow channel must have a large enough cross sectional area to provide effective fluid volume flow for cleaning, and yet not be so large as to cause a structural compromise of the tooth or cutter body. The optimal average cross section area is about 1/1000th of the cross section area of the borehole drilled by the bit. However, flow channels areas as large as 1/800th and as small as 1/1500th of the borehole area can be effective.

The purpose of the flow channels is to direct the fluid discharged from the directed bit nozzles so that the fluid moves around and between the gage teeth and across the rock surface with minimal reduction in velocity. The high velocity flow scours the rock surface at and around the point of tooth penetration to achieve a simultaneous combination of applied mechanical stress and fluid infiltration. In addition, the fluid cleaning action is applied to the cutter surface at the point of cutting, where applied weight-on-bit drilling forces wedge cuttings between the teeth. The result of the improved access for high-velocity flow is mitigation of chip hold down and balling, with higher rate of penetration and lower drilling costs.

According to the invention there is provided a tooth type rolling cutter drill bit having a plurality of rolling cutters mounted on legs, each rolling cutter having a back face portion and a gage face portion, a high velocity fluid nozzle corresponding with at least one of said rolling cutters to direct a stream of high velocity fluid toward said rolling cutter, said rolling cutter having a row of gage teeth to cut the gage of the borehole, said rolling cutter having at least one flow channel formed in its gage face portion to provide fluid communication from the back face of the cutter and between and around two adjacent gage teeth, and said flow channel being inclined at an angle to a radius of the cutter so as to be oriented towards the stream of fluid from said nozzle as the teeth adjacent to the flow channel engage the formation being drilled.

Preferably the gage face portion of the rolling cutter has a plurality of said flow channels spaced apart around the gage face portion, each flow channel providing fluid communication from the back face of the cutter and between and around a different pair of adjacent gage teeth. Each flow channel may be inclined at between 20 and 55 degrees to a radius of the cutter. The bit leg on which the cutter is mounted may be formed with a channel oriented to receive fluid from said stream of high velocity fluid and in intermittent fluid communication, as the cutter rotates, with the flow channel formed in the gage face portion of a cutter.

In any of the above arrangements the flow channel, or at least one of the flow channels may have a non-constant cross sectional area. There may be provided an erosion-resistant surface treatment on the surface of said flow channel. At least two of said gage teeth of the drill bit, for example adjacent teeth in a row of teeth adjacent the gage row, may be oriented at an angle to the longitudinal axis of the cutter such that the recess between the teeth is oriented at an angle to the longitudinal axis.

DETAILED DESCRIPTION OF THE PREFERRED EMBODIMENTS

Figure 1:
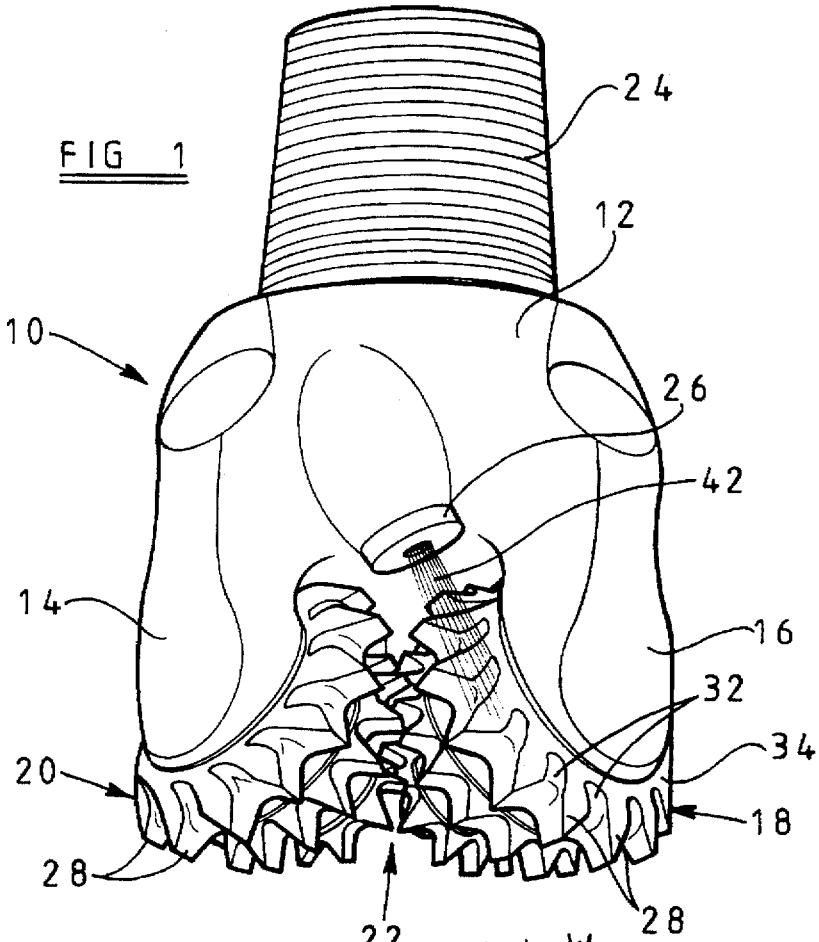
FIG. 1 is a perspective view of a tooth type drill bit in accordance with the present invention.

A tooth type rolling cutter drill bit is shown as numeral 10 of FIG. 1. The bit has a body 12 with three legs (only two are shown) 14, 16. Upon each leg is mounted a rolling cutter 18, 20, 22, only two of the cutters, 18 and 20, being visible in FIG. 1. During operation, the bit 10 is secured to drill pipe (not shown) by threads 24. The drill pipe is rotated and drilling fluid is pumped through the drill pipe to the bit 10 and exits through one or more nozzles 26. The weight of the drilling string forces the cutting teeth 28 of the cutters 18, 20, 22 into the earth, and as the bit is rotated, the earth causes the cutters to rotate upon the legs effecting a drilling action. The drilling fluid 42 exiting the nozzle 26 flushes away the earth removed by the cutter 18 and can remove cuttings which often adhere to the cutter 18. Similar nozzles (not shown) provide similar cleaning action for the other cutters 20, 22.

In one preferred embodiment, each rolling cutter 18, 20, 22 is formed in a solid state densification process primarily from powdered metal alloys. The process involves combining steel powders and wear resistant materials in a mould and making a finished part with a two step densification process. An exemplary solid state densification process is explained in detail by Ecer in U.S. Pat. No. 4,562,892. This manufacturing process is preferred not only because it provides teeth and hardmetal with superior wear resistance, but also because it is commercially economic in building shaped teeth and oriented flow channels.

Although solid state densification is the preferred means of manufacturing these cutters 18, 20, 22, the flow channels of the present invention would be equally effective with any other process available for forming cutters. For instance the cutters 18, 20, 22 could be machined from a solid block of steel and a hard, wear resistant coating selectively applied to their faces.

Figure 2:
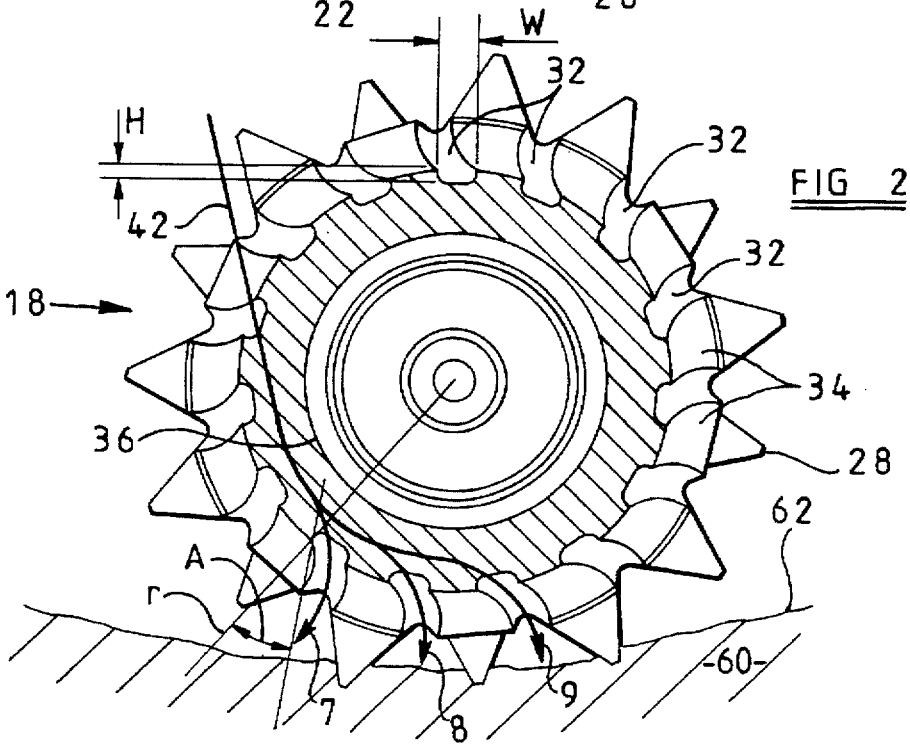
FIG. 2 is a rear view of a rolling cutter of a drill bit in accordance with the present invention.

The backface view of a cutter 18 of the present invention is shown in FIG. 2. The cutting teeth 28 are shown penetrating the hole bottom 62 into the formation 60. Flow channels 32 are formed into the gage face portion 34 of the cutter 18 and extend to the backface 36 of the cutter 18. Although the flow channels 32 are shown curved, they can also be effective in a straight geometry. Each flow channel 32 has a width W and a height H which define a cross sectional area of the flow channel. Because the width W and/or height H can vary over the length of the flow channel 32 the flow channel cross sectional area referred to in this specification is defined as the average cross sectional area over the length of the flow channel. In this preferred embodiment, this average cross sectional area is approximately one-one thousandth of the cross sectional area of the borehole drilled by the bit.

For example, a typical 7⅞ inch drill bit drills a borehole with a cross sectional area of about 48.7 square inches. For this bit, the width W of the flow channel is about 0.43 inches and the height H of the flow channel is about 0.11 inches. The cross section area of this flow channel is therefore about 0.047 square inches or 0.00097 (1/1030th) of the cross section area of the borehole.

Additionally, for another example, a typical 9⅞ inch drill bit drills a borehole with a cross sectional area of about 76.6 square inches. For this bit, the width W of the flow channel is about 0.48 inches and the height H of the flow channel is about 0.15 inches. The cross section area of this flow channel is therefore about 0.072 square inches or 0.00094 (1/1064th) of the cross section area of the borehole.

The minimum effective flow channel area in bits of the present invention is believed to be about 0.00067 of the cross section area of the borehole, or about 1/1500th of the cross section area of the borehole. In most bit designs, maximum flow channel areas are limited by cutter geometry constraints. However, in the tooth bits without cutter geometry constraints, the maximum flow channel area is limited to about 0.00125 of the cross section area of the borehole, or about 1/800th of the cross section area of the borehole. When the flow channels exceed this size, structural failures of the cutter body may occur.

The cross section areas of individual flow channels 32 on a cutter can be purposefully varied to control the flow rate of the high velocity fluid flow 42 between each set of teeth. This variation may be necessary, for instance, to eliminate fluid erosion around interleaving teeth in a particular cutter design. The average area of a flow channel 32 can be varied by making one portion of the flow channel 32 shallower or narrower, or by gradually changing the width W and/or height H of the flow channel 32 along its length.

Another important aspect of the flow charmers design is its orientation. As shown in FIG. 1, directed nozzle designs direct the high velocity fluid 42 from the nozzle 26 towards the leading side of the trailing cutter 18. In a tooth bit of the current invention, the flow channels 32 are each inclined at an angle A (as shown in FIG. 2) away from a radius r of the cutter so that each flow channel becomes oriented toward the corresponding nozzle 26 when the teeth adjacent to the flow channel engage the formation being drilled. Values for angle A can range from 20 degrees to 55 degrees from the radius r of the cutter. Due to the geometry of the bit and the borehole, orienting the flow channel at this angle A helps direct flow 42 from the nozzle 26 into the flow channels 32 adjacent to the teeth which are engaging the formation, as shown by the arrows 7, 8 and 9 in FIG. 2.

Figure 3:
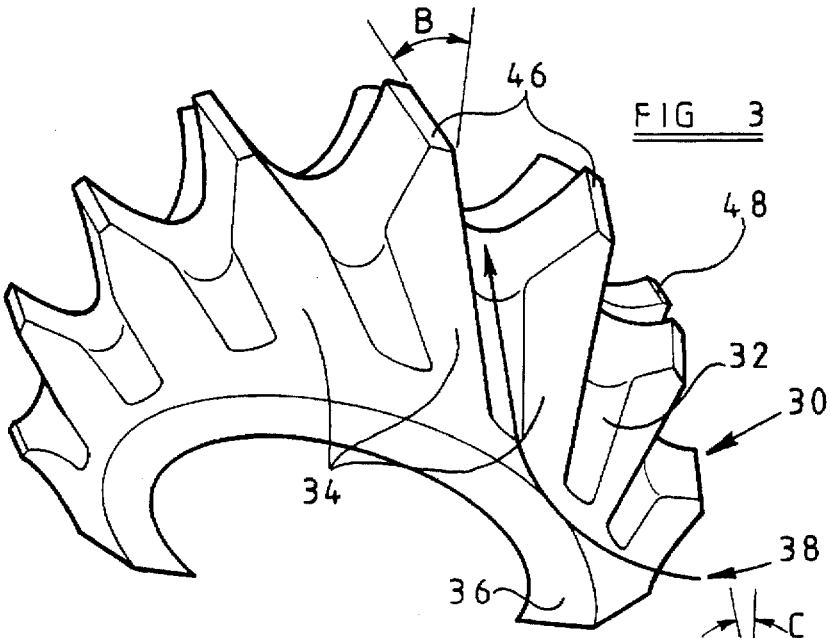
FIG. 3 is a perspective view of part of the cutter of FIG. 2.

This flow path is more clearly shown in FIG. 3. Since the side of the borehole is curved, and because the nozzle 26 is displaced vertically from the cutter, the high velocity fluid 42 is directed such that it curves in a spiralled path as shown by numeral 38 toward the flow channel 32. The approach angle of this spiral path can vary considerably with bit design, but most often the flow 42 approaches the gage face 34 of the cutter at between 20 and 55 degrees from a radius of the cutter. The flow channels 32 are therefore oriented to match this 20 to 55 degree angle of the flow from the corresponding nozzle 26.

The orientation of the flow channels 32 directs the high velocity flow 42 around and between the gage teeth 46 of the cutter. Although in conventional bits the gage teeth are usually the most difficult to clean, in the present invention the fluid flow 42 directed through the flow channels 32 and around the gage teeth 46 provides full cleaning of the gage teeth 46 and of the formation 62 between the gage teeth. Since the flow channels 32 more effectively clean the gage teeth 46 and the hole bottom 62, a bit of the present invention maintains its penetration rate in soft drilling better than conventional bits.

Figure 4:
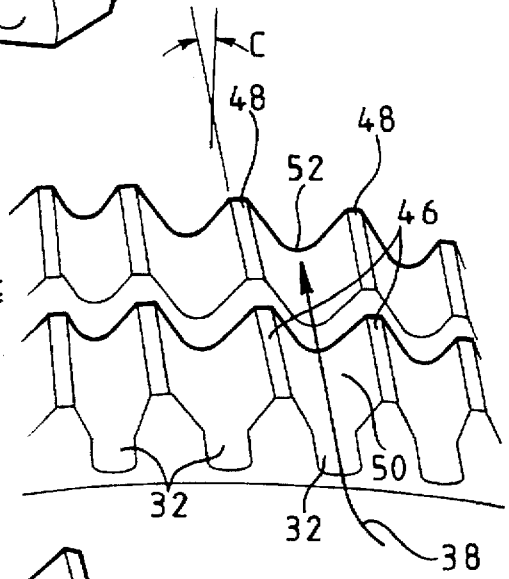
FIG. 4 is a perspective view of part of a rolling cutter in an alternative embodiment of the invention.

A further preferred embodiment of the flow channel design is shown in FIG. 4. The high velocity fluid flow path 38 can be continued from the gage teeth 46 through to the inner row teeth 48 of a tooth bit cutter 30. In this design, the inner row teeth 48 have a shallower recess 52 compared to the recess 50 between the gage teeth 46. This shallower recess helps maintain the fluid velocity as its flow rate drops due to dispersion of the flow as it crosses the face of the cutter. The passageways are typically designed to flatten and widen even more at the innermost rows of the cutter for the same reason. However, because most bit designs have at least one cutter with interlocked gage teeth or have inner row teeth 48 interleaved between gage row teeth 46, the flow through design shown in FIG. 4 is not likely to appear on all three of the cutters of a bit.

As is apparent from FIGS. 3 and 4, the crests of the teeth 46, 48 can be oriented at angles B, C from the longitudinal axis of the cutter. This allows better alignment of the recesses 50, 52 between the teeth 46, 48 to the flow path 38, resulting in a minimisation of flow disturbances.

Figure 5:
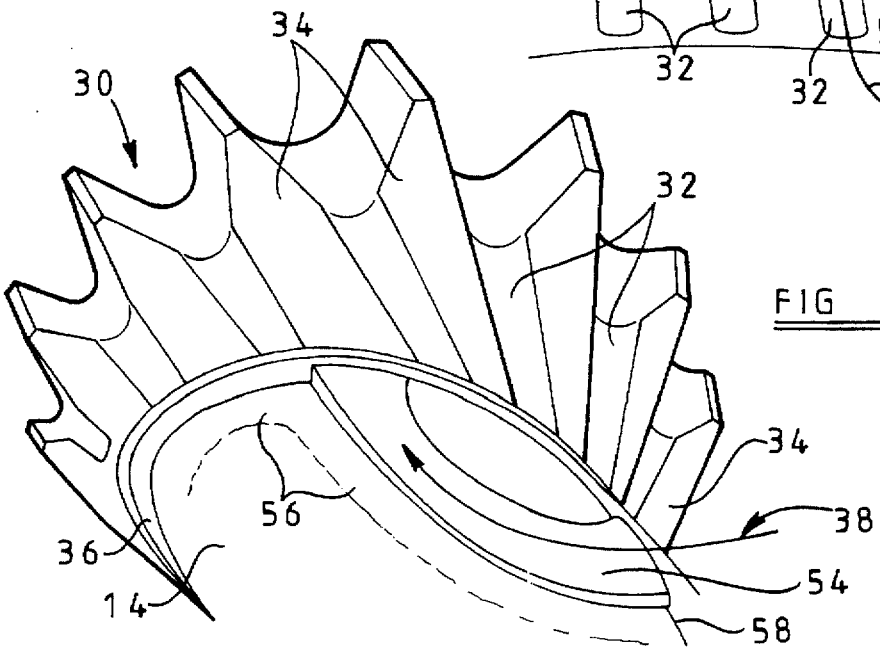
FIG. 5 is a perspective view of part of a rolling cutter in a further embodiment of the invention.

In many drill bits, especially on bits intended for steerable drilling assemblies, extra thick and/or extra wide layers of hard, wear resistant material are applied to the bit leg 14 adjacent the cutter. Although the extra hardmetal prevents premature wear of the leg 14 in this area, it also inhibits the flow of high velocity fluid. An alternative embodiment of the invention, shown in FIG. 5, solves this problem. To overcome the restriction to flow caused by the additional hardmetal 56, a leg flow channel 54 is provided in the bit leg. The flow enters this channel 54 at the edge of the bit leg 14 at the location shown as numeral 58 and is guided into the flow channels 32 of the cutter 30. In this design the cutter flow channels 32 are inclined at from 15 to 30 degrees from a radius of the cutter to align with the leg channel 54. As the cutter rotates when the bit drills, each flow channel 32 in the cutter intermittently communicates in succession with the channel 54 formed in the leg 14. The leg channel 54 is curved so that it is approximately oriented with the spiralling flow path 38 along its length. The entrance 58 of leg channel 54 is oriented toward its associated nozzle 26 in much the same manner as the previously described cutter flow channels 32.

There are many possible variations of flow channel designs not disclosed in this specification that fall within the scope of the present invention. In the broadest sense, any tooth type drill bit using liquid high velocity fluid with channels formed into the gage face or back face of a cutter which communicate with recesses between the teeth of the cutter are within the scope of this invention if the channels are oriented toward the flow from an adjacent nozzle.

For example, the flow channels in this specification are of generally uniform width and height. A flow channel could be designed with a reduced cross section area in a small portion of its length to reduce the amount of high velocity fluid it carries and still fall within the scope of this invention. In this case the reduced portion of the flow channel has the same effect as changing the width and/or height of a uniformly formed flow channel. Also the flow channels may be straight, or have any number of curved or tapered shapes depending upon the constraints of the particular tooth cutter design.

Whereas the present invention has been described in particular relation to the drawings attached hereto, it should be understood that other and further modifications, apart from those shown or suggested herein, may be made within the scope and spirit of the present invention.

What is claimed is:

1. A tooth type rolling cutter drill bit having a plurality of rolling cutters mounted on legs, each rolling cutter having a back face portion and a gage face portion, a high velocity fluid nozzle corresponding with at least one of said rolling cutters to direct a stream of high velocity fluid toward said rolling cutter, said rolling cutter having a row of gage teeth to cut the gage of the borehole, said rolling cutter having at least one flow channel formed in its gage face portion to provide fluid communication from the back face of the cutter and between and around two adjacent gage teeth, and said flow channel being inclined at an angle to a radius of the cutter so as to be oriented towards the stream of fluid from said nozzle as the teeth adjacent to the flow channel engage the formation being drilled.

2. A tooth type rolling cutter drill bit according to claim 1, wherein the gage face portion of the rolling cutter has a plurality of said flow channels spaced apart around the gage face portion, each flow channel providing fluid communication from the back face of the cutter and between and around a different pair of adjacent gage teeth.

3. A tooth type rolling cutter drill bit according to claim 1, wherein said flow channel has an average cross-sectional area greater than 1/1500th of the cross-sectional area of the borehole drilled by the bit.

4. A tooth type rolling cutter drill bit according to claim 1, wherein the flow channel has an average cross-sectional area of between 1/800th and 1/1500th of the cross sectional area of the borehole drilled by the bit.

5. A tooth type rolling cutter drill bit according to claim 1, wherein the flow channel is inclined at between 20 and 55 degrees to a radius of the cutter.

6. A tooth type rolling cutter drill bit according to claim 1, the bit leg is formed with a channel oriented to receive fluid from said stream of high velocity fluid and in intermittent fluid communication, as the cutter rotates, with the flow channel formed in the gage face portion of a cutter.

7. A tooth type rolling cutter drill bit according to claim 1, wherein the flow channel has a non-constant cross sectional area.

8. A tooth type rolling cutter drill bit according to claim 1, wherein there is provided an erosion-resistant surface treatment on the surface of said flow channel.

9. A tooth type rolling cutter drill bit according to claim 1., wherein at least two of said gage teeth of the drill bit are oriented at an angle to the longitudinal axis of the cutter such that the recess between the teeth is oriented at an angle to the longitudinal axis.

10. A tooth type rolling cutter drill bit according to claim 1, wherein at least two adjacent teeth in a row of teeth adjacent the gage row are oriented at an angle to the longitudinal axis of the cutter such that the recess between the teeth is oriented at an angle to the longitudinal axis.

* * * * *